US006238756B1

(12) United States Patent
Yee

(10) Patent No.: US 6,238,756 B1
(45) **Date of Patent: *May 29, 2001**

(54) CLOISONNE ARTICLES AND METHOD OF MAKING SAME

(76) Inventor: William F. Yee, 140 Woodland Ave., P.O. Box 26, Rochelle Park, NJ (US) 07662

( * ) Notice: Subject to any disclaimer, the term of this patent is extended or adjusted under 35 U.S.C. 154(b) by 0 days.

This patent is subject to a terminal disclaimer.

(21) Appl. No.: 09/443,659

(22) Filed: Nov. 19, 1999

(51) Int. Cl.[7] ..... B44F 1/06

(52) U.S. Cl. ..... 428/34.4; 428/38; 156/63; 206/575

(58) Field of Search ..... 428/34.4, 38, 13; 156/63; 206/568, 575

(56) References Cited

U.S. PATENT DOCUMENTS

| | | | | |
|---|---|---|---|---|
| 3,619,456 | | 11/1971 | Taylor | 264/245 |
| 3,839,080 | | 10/1974 | Jarema et al. | 117/132 |
| 4,016,235 | | 4/1977 | Ferro | 264/132 |
| 4,139,667 | | 2/1979 | Blue | 428/38 |
| 4,275,028 | | 6/1981 | Cohen | 264/126 |
| 4,312,688 | * | 1/1982 | Brodis et al. | 156/63 |
| 4,342,611 | | 8/1982 | Tuttle | 156/63 |
| 4,447,473 | | 5/1984 | Mashida et al. | 427/162 |
| 4,584,042 | * | 4/1986 | Wandroik | 156/280 |
| 4,597,146 | | 7/1986 | Larin | 29/160.6 |
| 4,655,981 | | 4/1987 | Nielsen et al. | 264/162 |
| 4,869,940 | | 9/1989 | Shoshani | 428/38 |
| 5,525,137 | * | 6/1996 | DiCarlo | 65/17.6 |
| 5,558,827 | | 9/1996 | Howes | 264/220 |
| 5,800,892 | | 9/1998 | Yee | 428/38 |
| 5,972,233 | * | 10/1999 | Becker et al. | 216/28 |

* cited by examiner

*Primary Examiner*—Rena L. Dye
(74) *Attorney, Agent, or Firm*—Wolff & Samson

(57) ABSTRACT

A glass cloisonne article and method of making same is provided. The glass cloisonne article includes a glass substrate which can be formed into a desired shape, such as a vase, votive or other desired shape, a framework of metal wire for forming a design on the glass substrate, one or more colored glazes, and a clear glaze which covers the outer surfaces of the colored glazed glass substrate. The glass cloisonne article is translucent and flame resistant and can be used as a votive that can be illuminated by a candle or other illuminating means. The glass substrate can also be shaped into a vase to hold flowers and water. Various other designs can be made including, but not limited to, ornaments, Christmas ornaments, boxes, picture frames, coasters, etc.

15 Claims, 3 Drawing Sheets

CLOISONNE ARTICLES AND METHOD OF MAKING SAME

SPECIFICATION

BACKGROUND OF THE INVENTION

1. Field of the Invention

This invention generally relates to glass cloisonne articles and the method of making same, and more particularly to a cloisonne article having a glass base or substrate.

2. Related Art

Cloisonne articles such as ornaments, boxes, vases, etc., have been conventionally manufactured by attaching a metal wire framework to a metallic substrate. In regions outlined by the particular pattern of metal wire which comprises the framework, colored glaze is applied. Thereafter, the article is coated with a transparent glaze and then fired at a high temperature, typically in a kiln.

The use of a metallic substrate limits the applications for which a cloisonne object can be used specifically, metal substrates are opaque and are therefore unsuitable to use where translucence is desired. If light could pass through the substrate, the cloisonne object would become translucent and could function as a votive or a lantern or other cover for a light, and the light from a candle or bulb placed therewithin could light up the cloisonne object and highlight the cloisonne work.

Additionally, such a cloisonne article with a glass substrate could be used as a vase. In the past, it has been known to paint ornamental glass balls on the inside thereof to produce Christmas ornaments, etc. It would be unsuitable, however, to paint a vase on the inside because water would react with the paint. Also, paint on the outside of a vase could be easily scratched. But a cloisonne vase would be decorative and durable.

Accordingly, what is needed, and has not heretofore been developed, is a cloisonne article having a translucent substrate that can be used as a votive or a vase or other article, and a method of making same.

Examples of previous efforts directed at decorative cloisonne articles include:

Yee, U.S. Pat. No. 5,800,892 discloses a cloisonne article and method of making same. The cloisonne article includes a non-metallic substrate which can be pre-molded into a fixed shape, a framework of strips for forming a design on the substrate, one or more colored glazes, and a clear glaze which covers the outer surfaces of the colored glazed substrate. The substrate is preferably comprised of a plastic such as a high-density polystyrene, polyprophylene, polyurethane or polyethylene that has a high melting point and is sufficiently rigid to withstand the temperature of firing. The cloisonne article can be formed into such shapes which include, but are not limited to, ornaments, Christmas ornaments, boxes, vases, picture frames, coasters, etc.

Howes, U.S. Pat. No. 5,558,827 discloses a decorative multipane window as a replica having a thick translucent layer of glass resin layer molded onto a sheet of glass. The method for making the decorative window comprises the steps of coating the glass sheet with an adherent material and clamping a mold, having a flat peripheral region and an inwardly extending cavity, to the glass sheet. Subsequently, the internal cavity of the mold is filled with a catalyzed transparent glass resin including the adherent material and allowing the resin to cure within the internal cavity. After the resin cures, the mold is removed. Lastly, a curable viscous fluid, which is a resin simulating conventional came or metallic connecting rod pieces of a conventional leaded glass window, is applied to the molded multipanes.

Shoshani, U.S. Pat. No. 4,869,940 discloses decorative glass products having patterns which are produced by coating the metal surface of a metal clad laminate with a photosensitive emulsion or film, superimposing a photographic negative of the required pattern on the photo sensitive coating, exposing the coating to ultraviolet light to produce a photographic positive, removing the unprotected metal areas by acid treatment and, if desired, removing the hardened photosensitive coating.

Nielsen et al., U.S. Pat. No. 4,655,981 discloses a method of producing a decorative pattern on the surface of a layer of soft, glass material. The method comprises whipping the soft surface by the free end portions by a plurality of flexible thread-like members to make depressions in the glass material. Once the depressions have been formed the glass material is hardened, cured or set. Often, the hardened plates are used as roofing plates.

Larin, U.S. Pat. No. 4,597,146 discloses a method of making lead, tin or zinc based alloy badges or emblems containing cloisonned areas into which colors can be introduced. The cloisonned areas are molded under pressure into the alloy of the substrate other alloys such as pewter and linotype which have minutely porous surfaces into which paint penetrates to provide a painted thickness of substantial depth.

Mashida et al., U.S. Pat. No. 4,447,473 discloses a method of producing decorative objects on which a light-interference surface layer shows a design that is produced by the steps of forming an oxidized metallic thin film on a glazed and baked surface of a substrate. The substrate is formed from metals such as copper, iron gold, silver, or steel as well as ceramics such as china and porcelain. The degree of oxidation of the metal film is controlled according to the desired pattern or design. At high temperatures, the metal oxide layer is dissolved into the glazing compound which covers the design and underlying substrate.

Tuttle, U.S. Pat. No. 4,342,611 discloses a process for producing stained glass objects comprising the steps of moistening a length of a glue impregnated string, placing the string onto a glass or glass object to be permanently affixed. Once affixed in place, a liquid colored stain is poured into the defined areas and allowed to dry.

Cohen, U.S. Pat. No. 4,275,028 discloses a glass ornament and a method for making same wherein multiple glass pellets are placed in the holes of a mesh, one pellet to each hole, according to a predetermined pattern. The pellets and mesh are heated until the pellets begin fusing together. The mesh is removed. The pellets may be heated further until the glass ornament achieves the desired smoothness.

Blue, U.S. Pat. No. 4,139,667 discloses an artwork creation in which gemstones are positioned on a laminated backing sheet and corralled with a cloisonne framework formed from a precious metal. The gemstones, and any related articles of jewelry, are equipped with clasps that fit into perforations made into the backing material.

Ferro, U.S. Pat. No. 4,016,235 discloses a method of making simulated stain glass from a moldable glass material. In making the stain glass design a glass film having a series of dark colored interconnected strips is held in place by a vacuum against the die surface while a moldable glass resin is injected into the die cavity. The heat and pressure generated by the exothermic reaction of the resin acts to mold the dark colored strips into pre-cut recesses while the resin itself fuses to the surface of the glass film to provide a composite structure which resembles stained glass.

Jarema et al., U.S. Pat. No. 3,839,080 discloses a glass coated metallic foam. The coating is an organo-polymer that can be employed singly or in combination of multiple resins to form laminar coats.

Taylor, U.S. Pat. No. 3,619,456 discloses an assembly made from glass but which appears to be stained glass in lead and a method for making same. In making the assembly, horizontally grooved glass canes are positioned on a horizontal surface in the framework of the desired design. The design is then filled with a filler material to the bottom of the grooves electrolyte composition and a method of using same. Various colored liquid glass are poured into the design to fill it to the top of the grooves. The liquid glass cures and the filler material is removed.

None of these previous efforts disclose all of the benefits of the present invention, nor do these previous patents teach or suggest all of the elements of the present invention.

OBJECTS AND SUMMARY OF THE INVENTION

It is a primary object of the present invention to provide a cloisonne article having a glass substrate.

It is an additional object of the present invention to provide a cloisonne article that is translucent.

It is an additional object of the present invention to provide a cloisonne article having a translucent glass substrate.

It is an additional object of the present invention to provide a cloisonne article having a glass substrate that can be used as a votive.

It is even another object of the present invention to provide a glass cloisonne article that can be shaped as desired and can be used in any application wherein translucence is desired.

It is even a further object of the present invention to provide a translucent glass cloisonne object that can be used to cover a light for decorative purposes.

It is an additional object of the present invention to provide a cloisonne article having a glass substrate that can be used as a vase.

It is an additional object of the present invention to provide a cloisonne article that can receive and hold water.

It is also an object of the present invention to provide a cloisonne article having a substrate that can be easily formed into a desired shape.

It is another object of the present invention to provide a glass cloisonne article for use for a utilitarian purpose that can be beautifully decorated.

These and other objects are achieved by the glass cloisonne article of the present invention that comprises a glass substrate formed into a desired shape such as a votive or a vase. A framework of metal strips or wires, which forms a design, can be attached to the substrate by glue. One or more colored glazes for coloring the design can then be applied. A clear glaze can be used to coat the framework and colored design. The article can be kiln fired or air dried. The article can be buffed or polished.

BRIEF DESCRIPTION OF THE DRAWINGS

Other important objects and features of the invention will be apparent from the following Detailed Description of the Invention when read in context with the accompanying drawings in which.

DETAILED DESCRIPTION OF THE INVENTION

Figure 1:
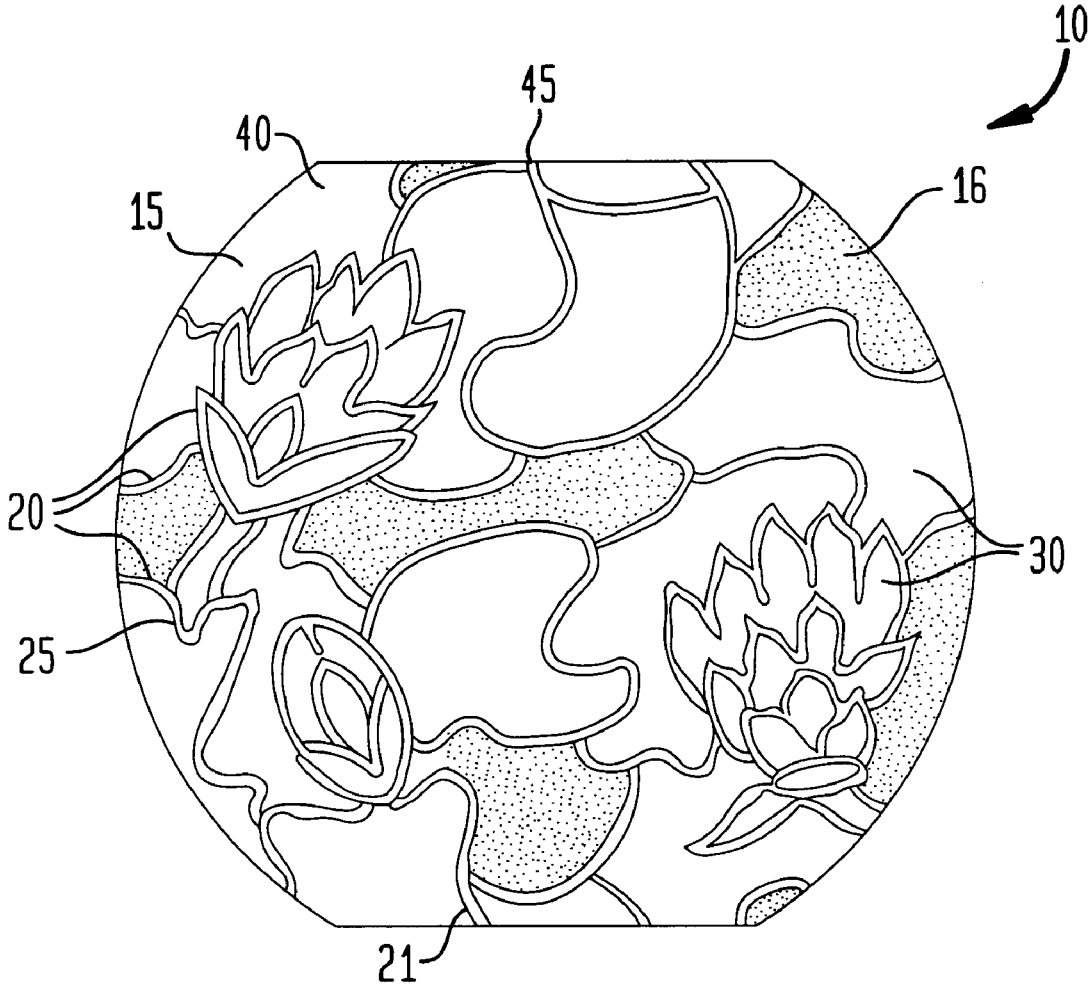
FIG. 1 is a side plan view of one embodiment of a glass cloisonne article of the present invention.
Figure 3:
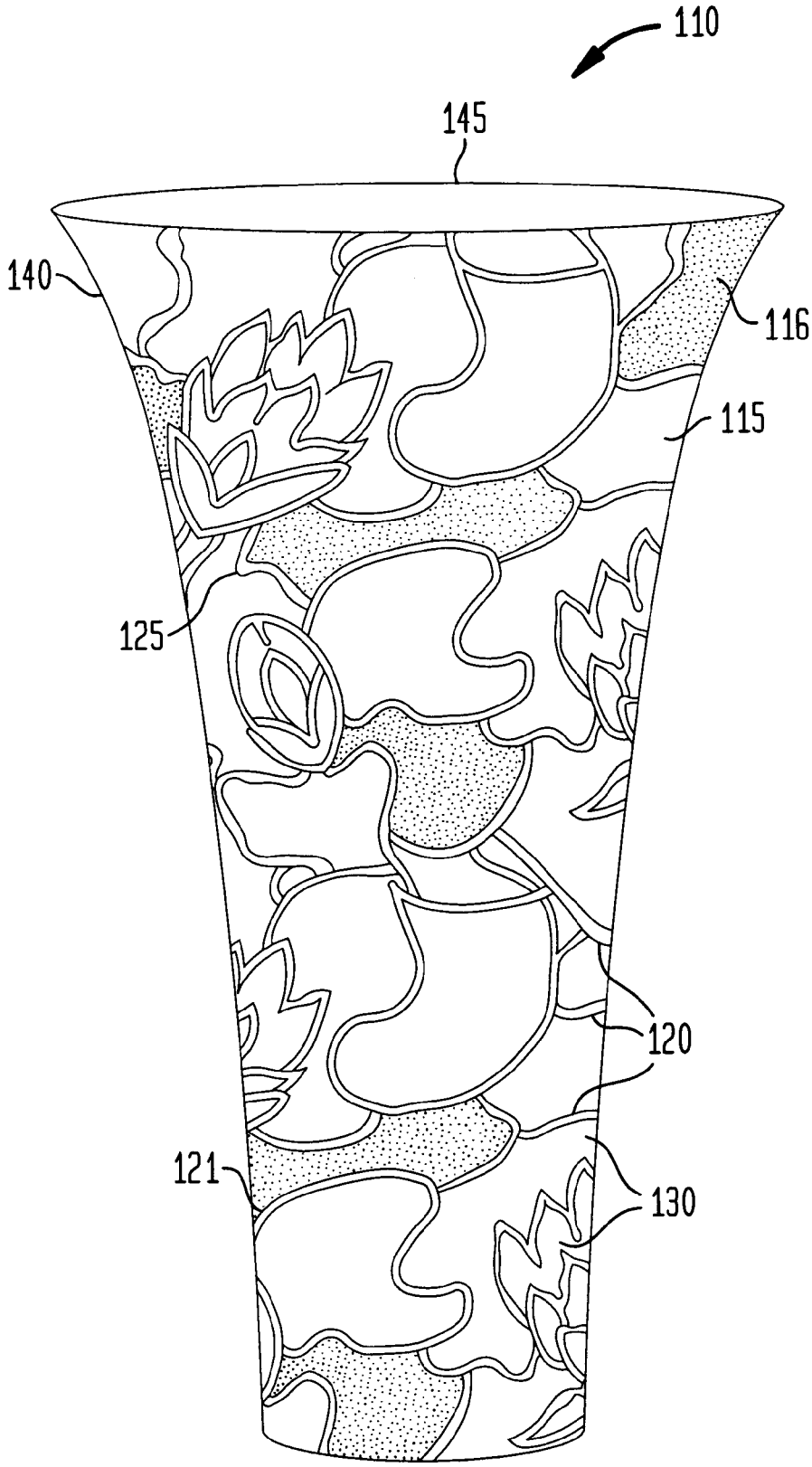
FIG. 3 is a perspective view of another embodiment of a glass cloisonne article of the present invention.

The present invention relates to a cloisonne article having a glass substrate and a method of making same. FIGS. 1 and 3, show various alternate embodiments of a glass cloisonne article, generally indicated at 10 and 110 respectively. FIG. 1 shows a glass cloisonne article formed as a votive, i.e., a decorative device for housing a small candle or other illumination means therein. For example, the present invention could have a light and take the form of a decorative light fixture housing the light. FIG. 3 shows a glass cloisonne article formed as a vase. Each design comprises a glass substrate 15 and 115, a metallic framework 20 and 120, attachment means 25 and 125 for securing the metallic framework 20 and 120 to the glass substrate 15 and 115, at least one colored glaze 30 and 130 and a clear glaze 40 and 140.

The glass substrate 15 forms the base or body of the article 10. In the past, a metal such as copper was used as the substrate for a traditional cloisonne article. Later it became known that plastic could be used to produce savings in the weight of the article, which translated to reduced shipping costs. The main benefit of using a glass substrate 15 is that, unlike metal, it is translucent, and unlike plastic, it is flame resistant. The glass substrate 15 is formed into a desired shape, such as a votive or a vase, by any means known in the art. Such shapes can be varied as desired. Also the glass substrate could be formed into other articles including, but not limited to, votives, ornaments, Christmas ornaments, boxes, vases, picture frames, lamps and/or parts thereof, wall hangings, animals, etc.

Figure 2:
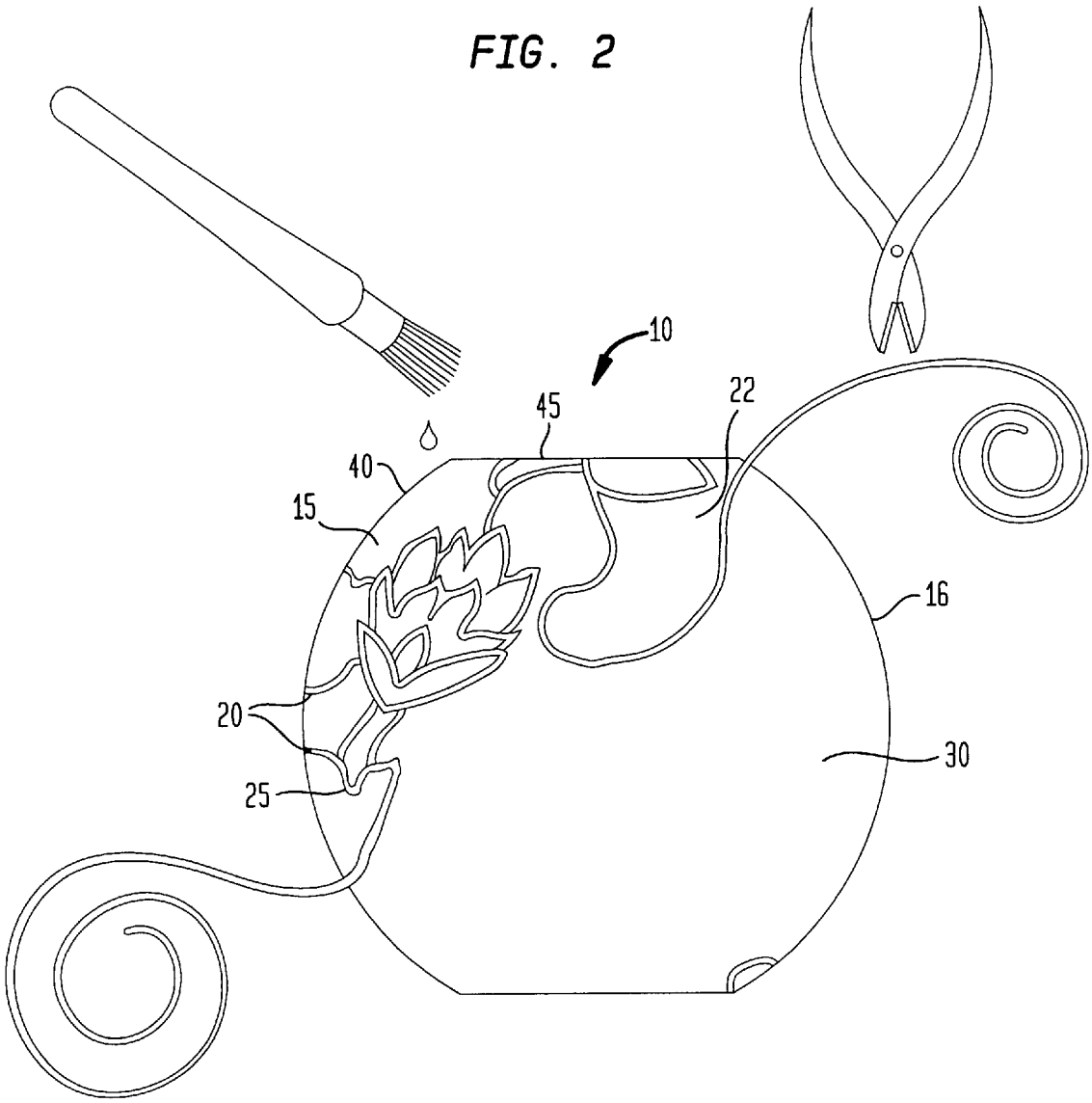
FIG. 2 is a side plan view of a partially completed glass cloisonne article shown in FIG. 1.

As shown in FIG. 2, a framework of metal wires is attached to the glass substrate to form a design or pattern. The framework 20 is a collection of connected metal wires or strips 21, preferably brass wire, which are suitably arranged to form a design. An exact fit between adjacent metal strips 21 is not necessary. Also, it may be desirable to attach a metal lip 45 about the opening of the article to finish the article. This can be done by attaching a metal lip 45 about the opening of the article. The metal lip 45 provides a smooth transition from the outside of the opening of the votive 10 to the inside of the article, and may serve to protect the article from chipping. The attachment means 25 for attaching the metal strips 21 and the lip 45 to the substrate 15 comprises an adhesive, preferably a water based glue. Such attachment means, as is known in the art, has substantial adhesive properties for bonding the metal strips 21 of the framework 20 to the exterior surface 16 of the glass substrate 15.

Once the framework 20 has been attached to the exterior surface 16 of the glass substrate 15, the design formed by the framework may be colored with colored glaze 30. The colored glaze 30 may be applied with a paintbrush or by any other means as is known in the art. After the colored glaze 30 dries, the article may be coated with a clear glaze 40, and then buffed or polished, as is known in the art, to shine-up the metal wires and to smooth-out the glaze. Suitable clear glazes include those used for china or porcelain, as well as glazes for metals such as enamel or conventional cloisonne glaze, and may be applied using conventional techniques, such as spraying, painting or brushing, as is practiced in the art.

Thereafter, the glazed article 10 may be kiln fired in an electric kiln or an open coal fire or air dried or otherwise finished as is known in the art.

FIG. 3 shows an alternate design of the glass cloisonne article of FIG. 1, i.e., a vase 110. The vase 110 of FIG. 3 may be constructed in the same fashion as the cloisonne article of FIG. 1, with the exception that the substrate is in a different shape. The elements of FIG. 3 correspond to those of FIG. 1 and have the same reference numerals plus 100.

As illustrated in FIG. 2, the method of making the glass cloisolme article of the present invention comprises the steps of molding or otherwise forming the glass substrate 15 into the desired shape of the article 10; cutting metal wire or strips 21; forming a design by attaching the metal wire strips 21 onto the glass substrate 15; attaching the metal wire or strips 21 to the glass substrate 15 by an adhesive or other attachment means 25; applying colored glaze 30 to color the design formed by the metal strips 21; allowing the colored glaze to dry; buffing or polishing the glazed article; applying clear glaze 40 to the article 10; and firing the article 10. The method may also include the step of attaching ancillary ornamentation once the article before or after firing.

Additionally, the aforementioned components which comprise the glass cloisonne article 10 may be sold as a kit of unassembled parts with appropriate assembly instructions. The components of the kit can be combined in the manner described above to create a vase, votive or other object having all the features, characteristics and attributes of a traditional cloisonne work of art, but also being translucent to allow an inner light to shine through the cloisonne article and to glow, or to allow the article to be used as a vase. Such a kit could contain a pre-formed glass substrate; metallic wire either in the form of a roll or in pre-cut pieces; adhesive means for attaching the wire to the substrate to form a design; colored glaze for coloring the design; means for buffing or polishing the article; and clear glaze means for coating the article.

Having thus described the invention in detail, it is to be understood that the forgoing description is not intended to limit the spirit and scope thereof. What is desired to be protected by the Letters Patent is set forth in the appended claims.

What is claimed is:

1. A decorative cloisonne article comprising:

a glass substrate;

a metal framework attached to the glass substrate;

means for attaching the framework to the glass substrate;

colored glaze means for coloring the article; and clear glaze means to finish the article.

2. The cloisonne article of claim 1 wherein the framework forms a design on the glass substrate.

3. The cloisonne article of claim 2 wherein the framework comprises of a plurality of metal strips.

4. The cloisonne article of claim 3 wherein the framework comprises metal wire.

5. The cloisonne article of claim 3 wherein the means for attaching the framework to the substrate comprises a water base glue.

6. A decorative cloisonne votive comprising:

a transparent substrate having an interior, an exterior, an interior flat bottom, and an open top;

a metal framework and means for attaching said framework to the exterior of the glass substrate;

colored glaze means for coloring the article;

clear glaze means to finish the article; and wherein a candle can be placed within the article on the interior flat bottom, to illuminate the finished article.

7. A decorative cloisonne vase comprising:

a glass substrate formed in the shape of a vase having an interior, an exterior, and an open top;

a metal framework attached to the exterior of the glass substrate;

means for attaching the framework to the exterior of the glass substrate;

colored glaze means for coloring the article;

clear glaze means to finish the article; and wherein flowers and water can be placed into the interior of the vase.

8. An illuminable cloisonne article comprising:

a transparent glass substrate having an interior, an exterior and an open top;

illumination means positioned in the interior for illuminating the article;

a metal framework and means for attaching said framework to the exterior of the glass substrate;

colored glaze means for coloring the article; and clear glaze means to finish the article.

9. A method of making a cloisonne article comprising the steps of:

forming a glass substrate into a desired shape;

forming a metallic framework into a design;

attaching the metallic framework onto the glass substrate to form a design on the glass substrate;

applying colored glaze to the design;

allowing the colored glaze to dry; and coating the article with a clear glaze.

10. The method of claim 9 further comprising the step of polishing the article.

11. The method of claim 10 further comprising firing the article.

12. The method of claim 11 further comprising air drying.

13. A kit of parts for forming a glass cloisonne article comprising:

a pre-formed glass substrate;

metal wire for attachment to the glass substrate;

adhesive for attaching the metal wire to the glass substrate to form a design;

at least one colored glaze for coloring the design;

polishing means for polishing the article; and clear glaze for application over the polished article.

14. The kit of claim 13 further including a plurality of colored glazes for creating a multi-colored article.

15. The kit of claim 14 wherein the wire is pre-cut into lengths for forming a design on the glass substrate.

* * * * *